US007515109B2

(12) United States Patent
Wei

(10) Patent No.: US 7,515,109 B2
(45) Date of Patent: Apr. 7, 2009

(54) WIRELESS COMMUNICATION DEVICE

(75) Inventor: Ming-Chun Wei, Taipei Hsien (TW)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 38 days.

(21) Appl. No.: 11/556,186

(22) Filed: Nov. 3, 2006

(65) Prior Publication Data

US 2007/0200776 A1 Aug. 30, 2007

(30) Foreign Application Priority Data

Feb. 24, 2006 (TW) ..... 95106266 A

(51) Int. Cl.
*H01Q 1/24* (2006.01)

(52) U.S. Cl. ..... 343/702; 343/906

(58) Field of Classification Search ..... 343/702, 343/841, 906; 439/95

See application file for complete search history.

(56) References Cited

U.S. PATENT DOCUMENTS 6,104,350 A * 8/2000 Ng et al. ..... 343/702
6,398,588 B1 6/2002 Bickford
6,976,856 B2 * 12/2005 Peng et al. ..... 439/95

* cited by examiner

*Primary Examiner*—Michael C Wimer
(74) *Attorney, Agent, or Firm*—Wei Te Chung

(57) ABSTRACT

A wireless communication device (10) includes an antenna (100), a printed circuit board (180), a signal cable (140), and a conducting portion (160). The antenna is used for transmitting and receiving electromagnetic signals. The printed circuit board has a grounding portion. The signal cable is electronically connected to the antenna and the printed circuit board for transmitting electromagnetic signals between the antenna and the printed circuit board. The conducting portion is used for conducting electromagnetic interference waves to the grounding portion.

11 Claims, 3 Drawing Sheets

WIRELESS COMMUNICATION DEVICE

BACKGROUND OF THE INVENTION

1. Field of the Invention

The present invention relates to an electronic device, and particularly to a wireless communication device.

2. Description of Related Art

When a wireless communication device transmits electromagnetic signals, electromagnetic interference (EMI) is also produced, and usually interferes with other wireless communication devices. Nowadays, many countries have constituted various testing specifications to avoid or reduce EMI. For example, it is prescribed in Europe that wireless communication devices must pass a test based on a specification defined by the European Economic Community (EEC), before the wireless communication devices are marketed.

Conventionally, a magnetic coil is disposed in the wireless communication device to prevent EMI waves from being transmitted via the antenna. However, EMI is not effectively reduced by this method.

Therefore, a heretofore unaddressed need exists in the industry to overcome the aforementioned deficiencies and inadequacies.

SUMMARY OF THE INVENTION

An exemplary embodiment of the invention provides a wireless communication device. A wireless communication device includes an antenna, a printed circuit board, a signal cable, and a conducting portion. The antenna is used for transmitting and receiving electromagnetic signals. The printed circuit board has a grounding portion. The signal cable is electronically connected to the antenna and the printed circuit board for transmitting electromagnetic signals between the antenna and the printed circuit board. The conducting portion is used for conducting EMI waves to the grounding portion.

Other objectives and novel features of the present invention will be drawn from the following detailed description of preferred embodiments of the present invention with the attached drawings, in which:

DETAILED DESCRIPTION OF THE INVENTION

Figure 1:
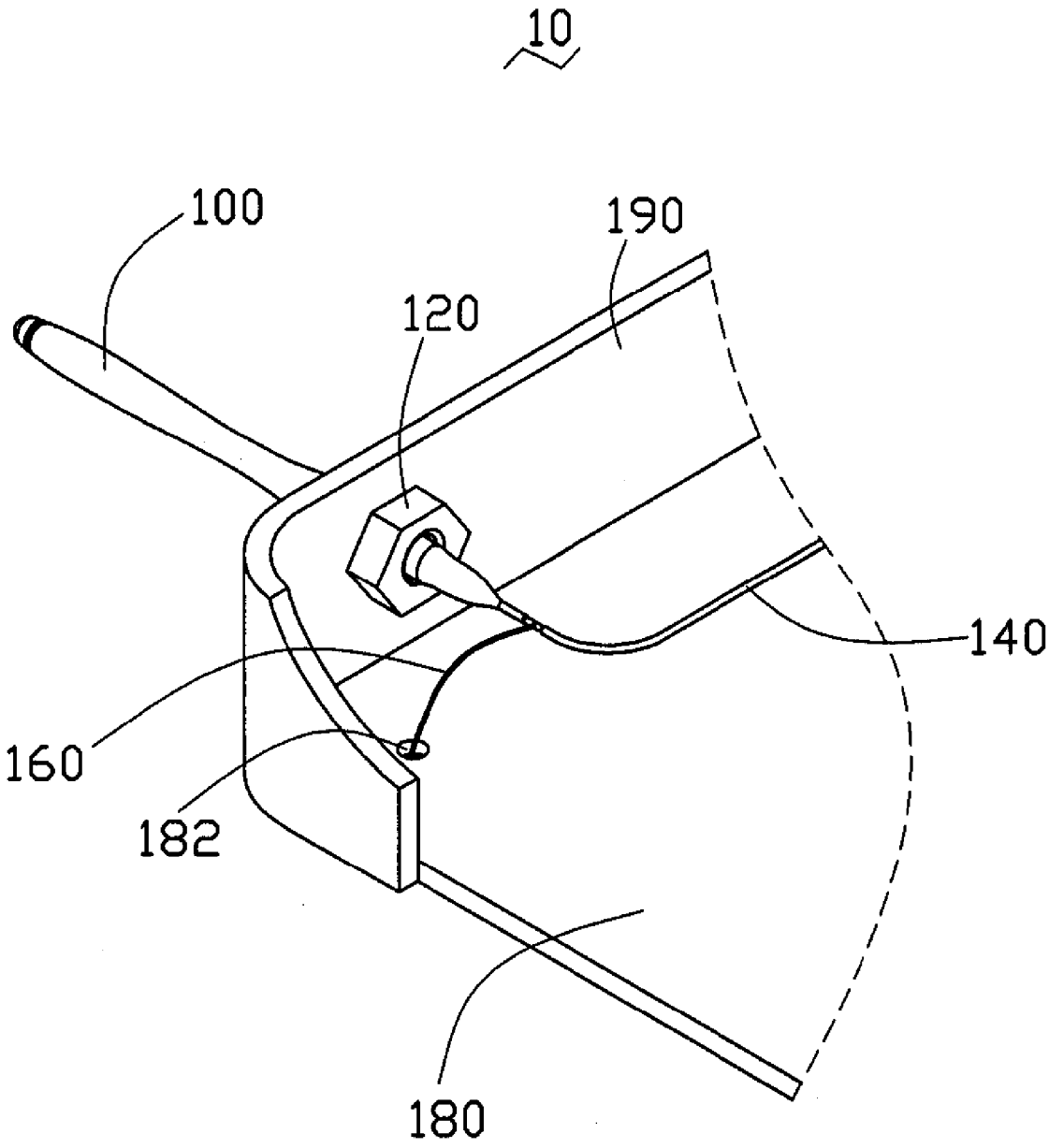
FIG. 1 is a schematic, isometric view of a wireless communication device of an exemplary embodiment of the invention.

FIG. 1 is a schematic, isometric view of a wireless communication device 10 of an exemplary embodiment of the invention.

The wireless communication device 10 includes an antenna 100, a fastener 120, a signal cable 140, a conducting portion 160, a printed circuit board 180, and a body 190.

The antenna 100 is used for transmitting and receiving electromagnetic signals. The antenna 100 is connected to the body 100 by the fastener 120. The signal cable 140 is electronically connected to the antenna 100, for transmitting electromagnetic signals between the antenna 100 and the printed circuit board 180. The printed circuit board 180 has a grounding portion. In this embodiment, a through hole 182 plated with a metal layer, as a grounding portion, is formed on the printed circuit board 180. The conducting portion 160 is a cable electronically connected to the signal cable 140 or a connection of the signal cable 40 and the antenna 100, and passes through the through hole 182, for conducting electromagnetic interference (EMI) waves from the antenna 100 to the through hole 182.

Figure 2:
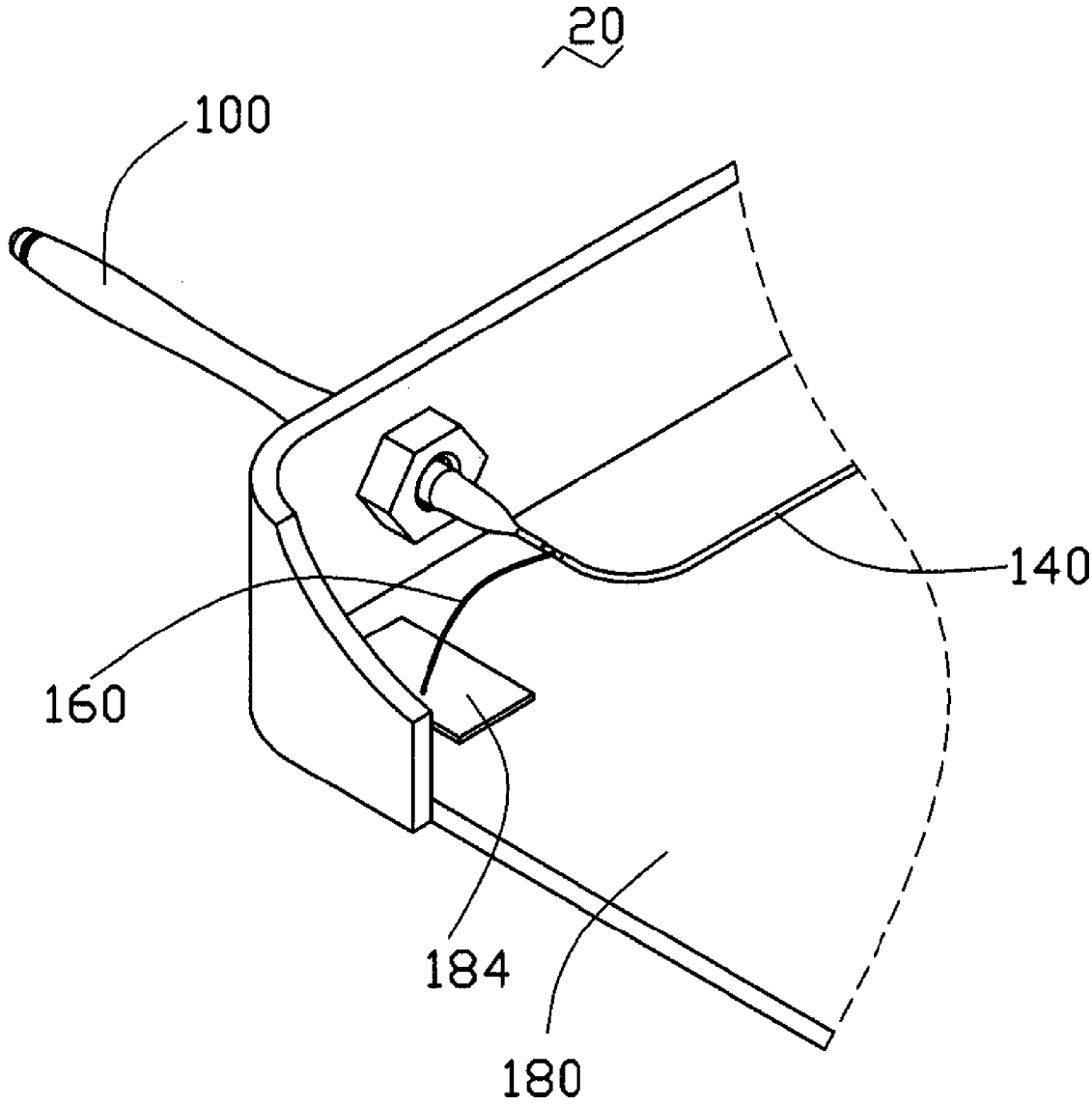
FIG. 2 is a schematic, isometric view of a wireless communication device of another exemplary embodiment of the invention.

FIG. 2 is a schematic, isometric view of a wireless communication device 20 of another exemplary embodiment of the invention.

Other components and configurations of the wireless communication device 20 are the same as those of the wireless communication device 10 in FIG. 1, and the difference therebetween is that the wireless communication device 20 further includes a metal layer 184, as a grounding portion of the printed circuit board 180, disposed on the printed circuit board 180 of the wireless communication device 20. The conducting portion 160 is a cable electronically connected to the signal cable 140 or the connection of the signal cable 40 and the antenna 10, and the metal layer 184, respectively, for conducting EMI waves from the antenna 100 to the metal layer 184.

Figure 3:
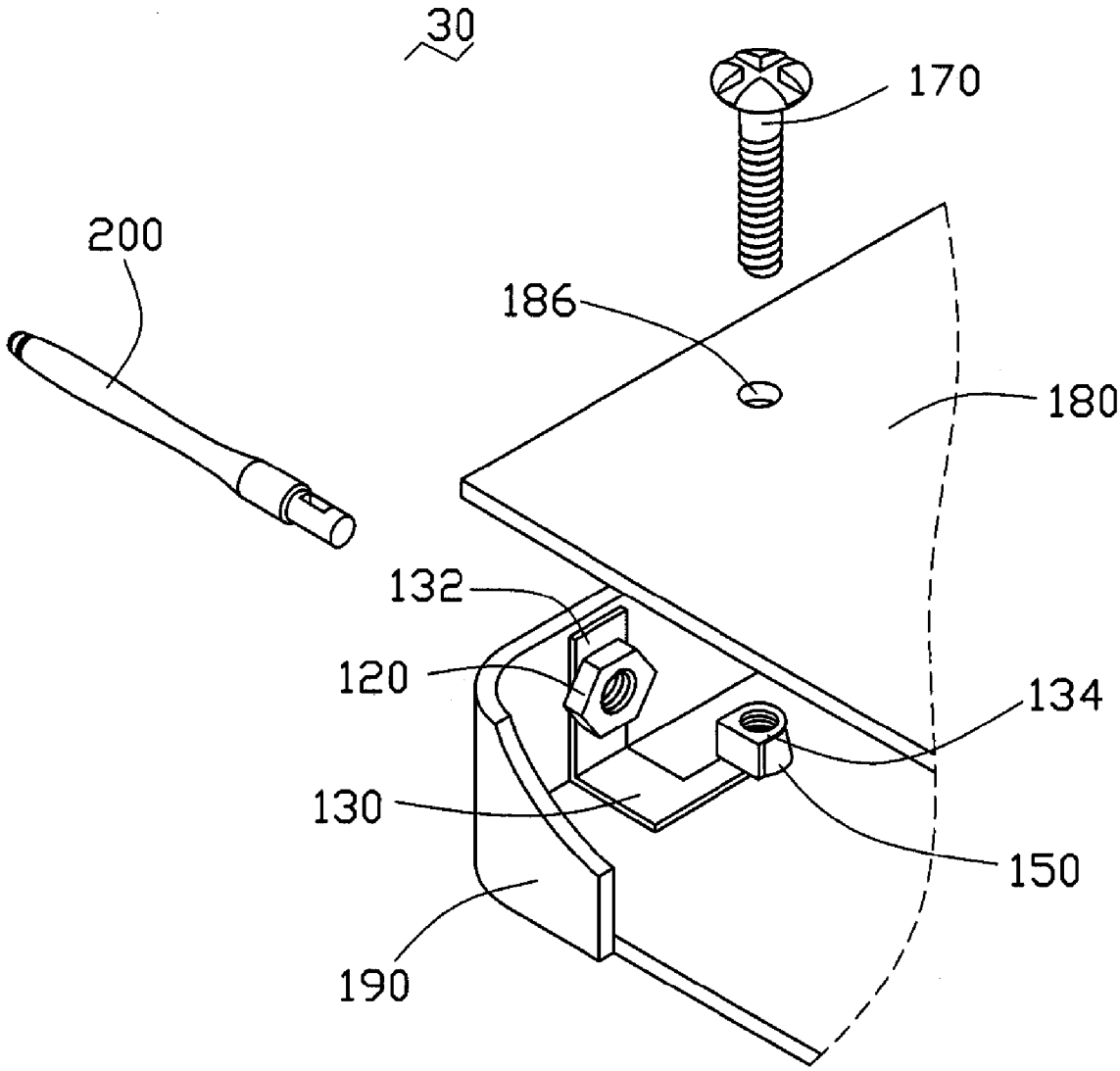
FIG. 3 is a schematic, isometric view of a wireless communication device of a further exemplary embodiment of the invention.

FIG. 3 is a schematic, isometric view of a wireless communication device 30 of further exemplary embodiment of the invention.

The wireless communication device 30 includes a fastener 120, a conducting portion 130, a retainer 150, a screw 170, a printed circuit board 180, a body 190, and an antenna 200.

The fastener 120 is used for fixing the antenna 200 on the body 190. The conducting portion 130 includes a first end 132 connected to the body 190 and the fastener 120, and a second end 134 connected to the retainer 150, the screw 170, and the printed circuit board 180. The conducting portion 130 comprises a metal plate electronically connected to the antenna 200, or near the connection of the antenna 200 and the signal cable (not shown), and acts as a grounding portion for conducting EMI waves from the antenna 100 to the ground. The retainer 150 is connected to the body 190. The screw 170 is engaged with the hole 186 formed on the printed circuit board 180 and the retainer 150 to position the conducting portion 130. In this embodiment, the antenna 200 is retractable and detachable.

The wireless communication devices 10, 20, and 30 conduct EMI waves from the antenna 100, 200 to the grounding portion in different ways such that EMI is effectively minimized and EMI waves are prevented from being transmitted out via the antennas 100, and 200.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A wireless communication device, comprising:

an antenna for transmitting and receiving electromagnetic signals;

a printed circuit board comprising a grounding portion;

a signal cable electronically connected to the antenna and the printed circuit board, for transmitting electromagnetic signals between the antenna and the printed circuit board; and a conducting portion for conducting electromagnetic interference waves to the grounding portion;

a body; and a retainer connected to the body:

wherein a hole is defined on the printed circuit board and engaged with the retainer to position the conducting portion.

2. The wireless communication device as recited in claim 1, further comprising a fastener engaged with the body to fix the antenna.

3. The wireless communication device as recited in claim 2, further comprising a screw engaged with the hole and the retainer to position the conducting portion.

4. The wireless communication device as recited in claim 3, wherein the conducting portion comprises a first end connected to the body and the fastener.

5. The wireless communication device as recited in claim 4, wherein the conducting portion further comprises a second end connected to the printed circuit board, the retainer, and the screw.

6. A wireless communication device comprising:

an antenna of said wireless communication device for transmitting and receiving electromagnetic signals;

a printed circuit board of said wireless communication device comprising a grounding portion for grounding use;

a signal cable electrically connectable between said antenna and said printed circuit board for transmitting said electromagnetic signals between said antenna and said printed circuit board; and a conducting portion electrically connectable between said grounding portion of said printed circuit board and a connection of said antenna and said signal cable so as to transmit electromagnetic interference waves around said antenna and said signal cable toward said grounding portion for grounding.

7. The wireless communication device as recited in claim 6, wherein said conducting portion comprises a cable electrically connectable with a selective one of a grounded metal layer and a through hole plated with a grounded metal layer formed in said printed circuit board.

8. The wireless communication device as recited in claim 6, wherein said conducting portion camprises a metal plate electrically connectable to said antenna at one end thereof and electrically connectable to said printed circuit board through a retainer at the other end thereof.

9. A wireless communication device comprising:

an antenna to transmit and receive electromagnetic signals for said wireless communication device;

a grounding portion disposed in said wireless communication device for grounding use;

a signal cable electrically connectable with said antenna to transmit said electromagnetic signals from and toward said antenna inside said wireless communication device; and a conducting portion electrically connectable between said grounding portion and a connection of said antenna and said signal cable so as to electrically conduct electromagnetic interference waves around said antenna and said signal cable toward said grounding portion for grounding.

10. The wireless communication device as recited in claim 9, wherein said conducting portion comprises a cable electrically connectable with a selective one of a grounded metal layer and a through hole plated with a grounded metal layer which are respectively performed as said grounding portion.

11. The wireless communication device as recited in claim 9, wherein said conducting portion comprises a metal plate electrically connectable to said antenna at one end thereof and electrically connectable to said grounding portion through a retainer at the other end thereof.

* * * * *